US011732584B2

(12) United States Patent
Lee et al.

(10) Patent No.: US 11,732,584 B2
(45) Date of Patent: Aug. 22, 2023

(54) ROTARY COMPRESSOR WITH UNEQUALLY SPACED VANE SLOTS

(71) Applicant: LG ELECTRONICS INC., Seoul (KR)

(72) Inventors: Jonghun Lee, Seoul (KR); Seoungmin Kang, Seoul (KR); Seungmock Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/536,222

(22) Filed: Nov. 29, 2021

(65) Prior Publication Data

US 2022/0228587 A1 Jul. 21, 2022

(30) Foreign Application Priority Data

Jan. 18, 2021 (KR) ..... 10-2021-0006830

(51) Int. Cl.
*F01C 21/08* (2006.01)
*F04C 18/344* (2006.01)

(52) U.S. Cl.
CPC ..... *F01C 21/0809* (2013.01); *F04C 18/3446* (2013.01); *F04C 2240/10* (2013.01); *F04C 2250/30* (2013.01)

(58) Field of Classification Search
CPC ..... F01C 21/0809; F04C 18/3446; F04C 2240/10; F04C 2250/30
See application file for complete search history.

(56) References Cited

U.S. PATENT DOCUMENTS

2015/0064042 A1 3/2015 Shimaguchi et al.
2018/0187680 A1 7/2018 Moon et al.

FOREIGN PATENT DOCUMENTS

| | | |
|---|---|---|
| CN | 104471251 | 3/2015 |
| CN | 105431635 | 3/2016 |
| CN | 107269525 | 10/2017 |
| CN | 108691766 | 10/2018 |
| CN | 108953154 | 12/2018 |
| JP | 2003-227484 | 8/2003 |

(Continued)

OTHER PUBLICATIONS

Japanese Patent Publication JP 2003-227484 with Machine Translation, Inventor: Hidehisa, Title: Gas Compressor, Published: Aug. 15, 2003. (Year: 2003).*

(Continued)

*Primary Examiner* — Mary Davis
(74) *Attorney, Agent, or Firm* — Ked & Associates

(57) ABSTRACT

A rotary compressor is provided that may include a cylinder having an inner circumferential surface with an annular shape to form a compression space; a roller having a plurality of vane slots disposed at predetermined intervals along an outer circumferential surface thereof, and rotatably inserted into the compression space of the cylinder; and a plurality of vanes slidably inserted into the respective vane slots to rotate together with the roller and by which the compression space is divided into a plurality of compression chambers. At least one of the vane slots is unequally spaced in a circumferential direction. Accordingly, periodicity of noise may be reduced to thereby increase the effect of noise reduction of the compressor.

18 Claims, 11 Drawing Sheets

(56) References Cited

FOREIGN PATENT DOCUMENTS

| | | |
|---|---|---|
| JP | 2005-337115 | 12/2005 |
| JP | 2019-082139 | 5/2019 |

OTHER PUBLICATIONS

Korean Patent Publication KR 10-2018-007942 with Machine Translation, Inventor: Hwan, Title: Hermetic Compressor, Published: Jul. 9, 2018. (Year: 2018).*
Chinese Office Action issued in Application No. 202111569581.7 dated Apr. 19, 2023.

* cited by examiner

ROTARY COMPRESSOR WITH UNEQUALLY SPACED VANE SLOTS

CROSS-REFERENCE TO RELATED APPLICATION(S)

Pursuant to 35 U.S.C. § 119(a), this application claims the benefit of the earlier filing date and the right of priority to Korean Patent Application No. 10-2021-0006830, filed on Jan. 18, 2021, the contents of which are incorporated by reference herein in their entirety.

BACKGROUND

1. Field

A vane rotary compressor in which a vane is coupled to a roller is disclosed herein.

2. Background

Rotary compressors may be divided into two types, namely, a type in which a vane is slidably inserted into a cylinder to come in contact with a roller, and a type in which a vane is slidably inserted into a roller to come in contact with a cylinder. Generally, the former is referred to as a roller eccentric rotary compressor (hereinafter, a "rotary compressor"), and the latter is referred to as a vane concentric rotary compressor (hereinafter, a "vane rotary compressor").

As for the rotary compressor, a vane inserted into a cylinder is pulled out toward a roller by elastic force or back pressure to come into contact with an outer circumferential surface of the roller. On the other hand, as for the vane rotary compressor, a vane inserted into a roller rotates together with the roller and is pulled out toward a cylinder by centrifugal force and back pressure to come into contact with an inner circumferential surface of the cylinder.

A rotary compressor independently forms as many compression chambers as the number of vanes per revolution of a roller, and each compression chamber simultaneously performs suction, compression, and discharge strokes. On the other hand, a vane rotary compressor continuously forms an many compression chambers as the number of vanes per revolution of a roller, and each compression chamber sequentially performs suction, compression, and discharge strokes. Accordingly, the vane rotary compressor has a higher compression ratio than the rotary compressor. Therefore, the vane rotary compressor is more suitable for high pressure refrigerants, such as R32, R410a, and $CO_2$, which have low ozone depletion potential (ODP) and global warming index (GWP).

Such a vane rotary compressor is disclosed in U.S. Patent Application No. 2015/0064042 A1 (hereinafter, "Patent Document 1"), which is hereby incorporated by reference. The vane rotary compressor disclosed in Patent Document 1 is a low-pressure type in which a suctioned refrigerant is filled in an inner space of a motor chamber but has a structure in which a plurality of vanes is slidably inserted into a rotating roller, which is a feature of the vane rotary compressor.

In the vane rotary compressor disclosed in Patent Document 1, an inner circumferential surface of a cylinder defining a compression space is formed as a plurality of curves. For example, the inner circumferential surface of the cylinder disclosed in Patent Document 1 may be formed in an asymmetric elliptical shape eccentric with respect to an axial center of a rotational shaft. Accordingly, the inner circumferential surface of the cylinder has a proximal portion which is closest to the axial center and a remote portion which is farthest away from the axial center, and the proximal portion and the remote portion are connected by curved surfaces having different aspect ratios.

An outer circumferential surface of the roller has a circular shape with a constant curvature such that the roller is disposed concentrically with respect to the axial center of the rotational shaft. The plurality of vane slots is recessed into the outer circumferential surface of the roller by a predetermined depth and disposed at equal intervals along the outer circumferential surface of the roller.

When the inner circumferential surface of the cylinder is formed in the asymmetric elliptical shape biased in a specific direction, an inflection point may be generated on the inner circumferential surface of the cylinder at a point at which two ellipses having different aspect ratios meet. The largest inflection point may occur at a portion defining the distal portion. Accordingly, as a length of the vane pulled out from the vane slot of the roller becomes the greatest (longest) around the inflection point or both sides including the inflection point when the roller rotates, the loudest impulse sound due to collision between the vane and the cylinder is generated. The impulse sound may occur periodically due to the equally spaced vanes, causing noise of the compressor to be increased.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a vane rotary compressor according to embodiments disclosed herein, with reference to the accompanying drawings. For reference, vane slots of a roller according to embodiments may also be applied to a vane rotary compressor in which a vane is slidably inserted into a roller. They may be equally applied when vane slots are formed in an inclined manner as described herein, as well as when vane slots are formed radially. In addition, the vane slots of the roller according to embodiments may also be applicable regardless of a shape of an inner circumferential surface of a cylinder. For example, they may be equally applied to a cylinder having an inner circumferential surface with an asymmetric or symmetric elliptical shape, and a cylinder having an inner circumferential surface with a circular shape. Hereinafter, description will be mainly given of an example in which vane slots are obliquely or inclinedly formed in a roller and an inner circumferential surface of a cylinder has an asymmetric elliptical shape.

Figure 1:
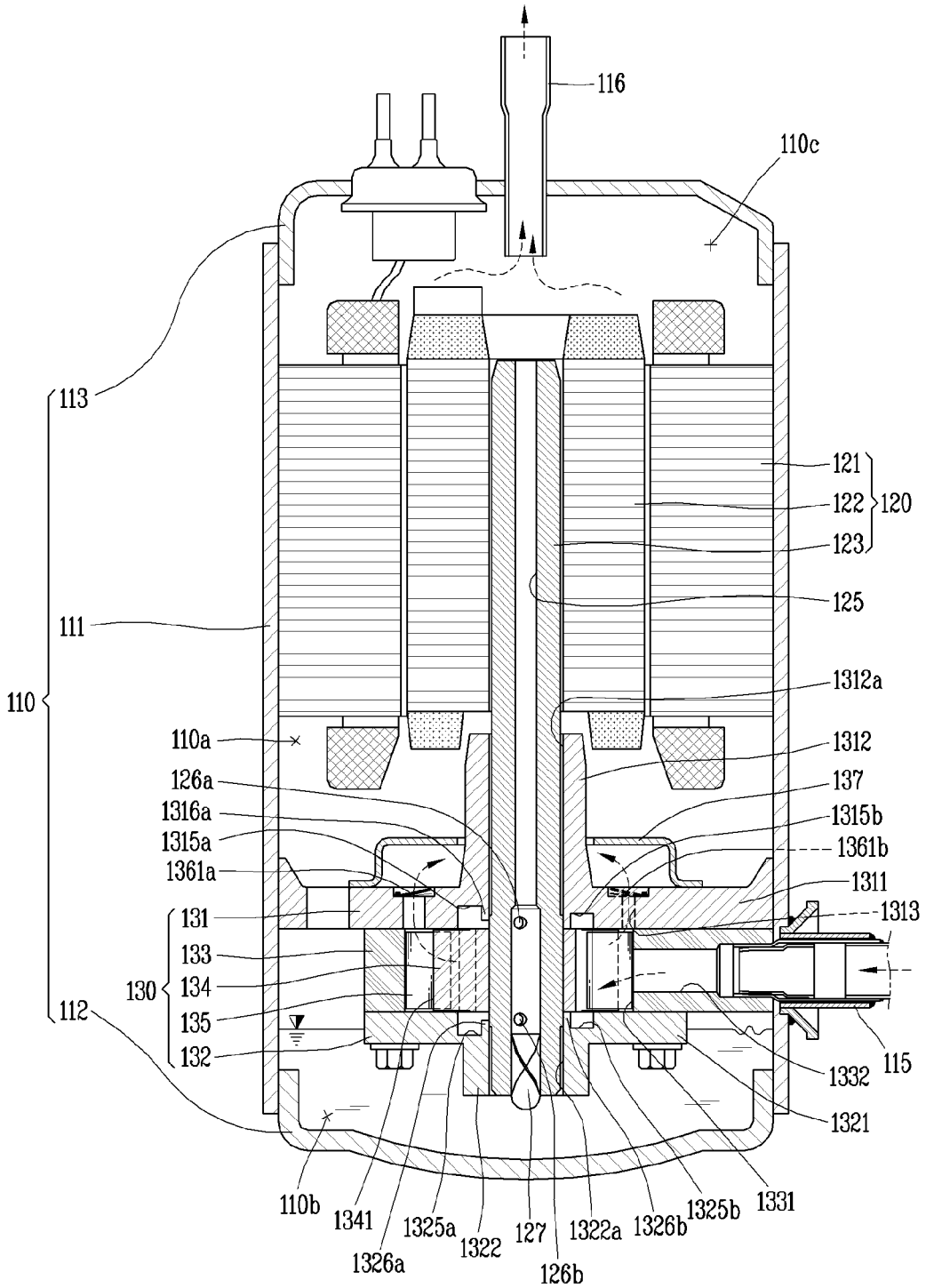
FIG. 1 is a longitudinal cross-sectional view of a vane rotary compressor according to an embodiment.
Figure 2:
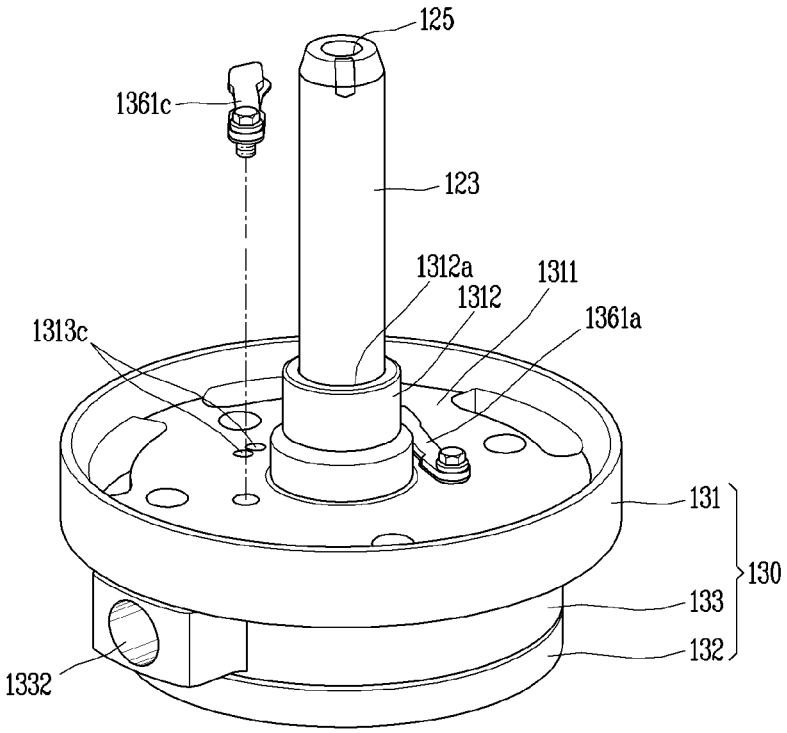
FIG. 2 is an assembled perspective view of a compression unit of FIG. 1.
Figure 3:
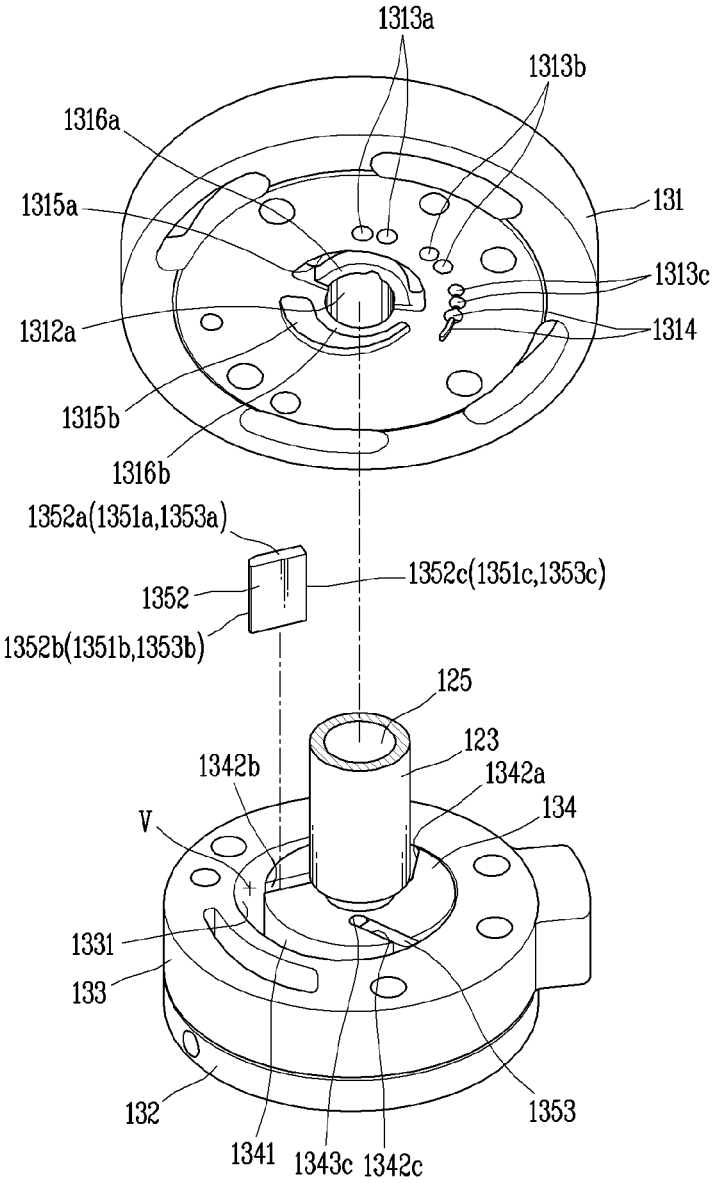
FIG. 3 is an exploded perspective view of the compression unit of FIG. 2.
Figure 4:
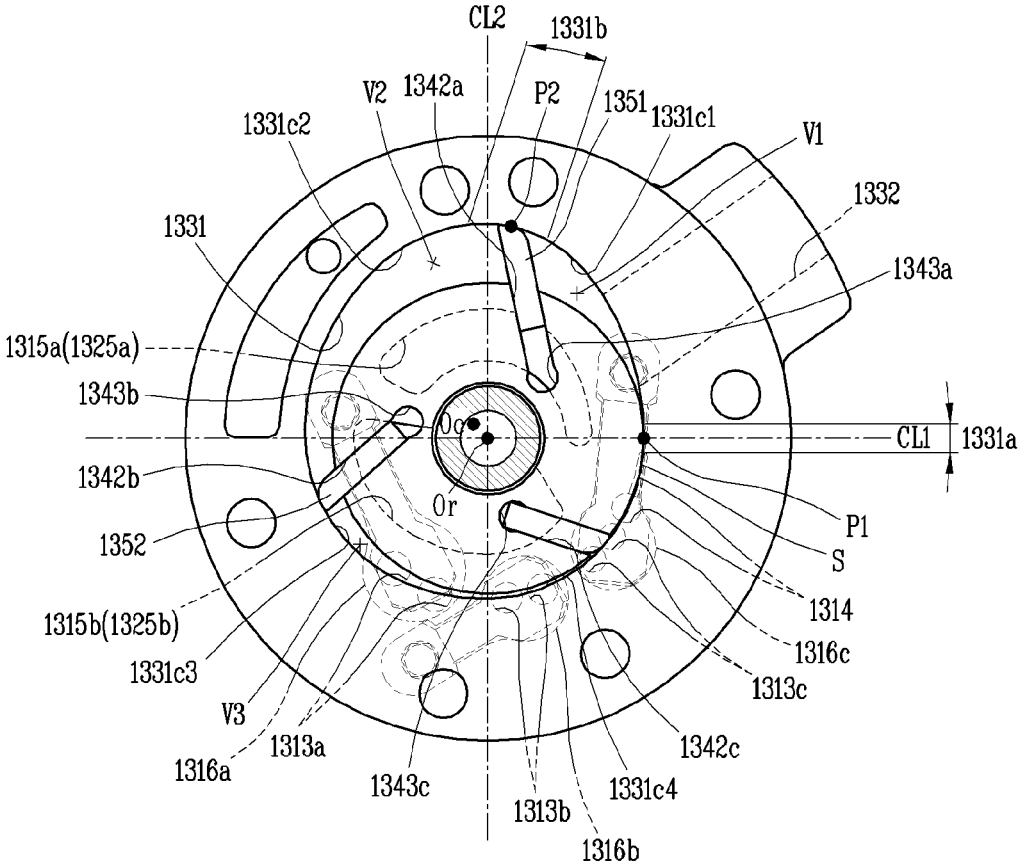
FIG. 4 is a planar view illustrating a portion of the compression unit in FIG. 3.

FIG. 1 is a longitudinal cross-sectional view of a vane rotary compressor according to an embodiment. FIG. 2 is an assembled perspective view of a compression unit of FIG. 1. FIG. 3 is an exploded perspective view of the compression unit of FIG. 2. FIG. 4 is a planar view illustrating a portion of the compression unit in FIG. 3.

Referring to FIG. 1, a vane rotary compressor according to this embodiment may include a casing 110, a drive motor 120, and a compression unit 130. The drive motor 120 may be installed in an upper inner space of the casing 110, and the compression unit 130 may be installed in a lower inner space of the casing 110. The drive motor 120 and the compression unit 130 may be connected through a rotational shaft 123.

The casing 110 which defines an outer appearance of the compressor may be classified as a vertical type and a horizontal type according to a compressor installation method. In the vertical type casing, the drive motor 120 and the compression unit 130 are disposed at upper and lower sides in an axial direction, respectively. As for the horizontal type casing, the drive motor 120 and the compression unit 130 are disposed at left and right sides, respectively. The casing according to this embodiment may be the vertical type.

The casing 110 may include an intermediate shell 111 having a cylindrical shape, a lower shell 112 that covers a lower end of the intermediate shell 111, and an upper shell 113 that covers an upper end of the intermediate shell 111. The drive motor 120 and the compression unit 130 may be inserted into the intermediate shell 111 to be fixedly coupled thereto, and a suction pipe 115 may be formed through the intermediate shell 111 to be directly connected to the compression unit 130.

The lower shell 112 may be sealed and coupled to the lower end of the intermediate shell 111, and an oil storage space 110*b* in which oil to be supplied to the compression unit 130 is stored may be formed below the compression unit 130. The upper shell 113 may be sealed and coupled to the upper end of the intermediate shell 111, and an oil separation space 110*c* may be formed above the drive motor 120 to separate oil from refrigerant discharged from the compression unit 130.

The drive motor 120 which constitutes a motor unit provides power to cause the compression unit 130 to be driven. The drive motor 120 may include a stator 121, a rotor 122, and the rotational shaft 123.

The stator 121 may be fixedly inserted into the casing 110. The stator 121 may be fixed to an inner circumferential surface of the cylindrical casing 110 in a shrink-fitting manner, for example. For example, the stator 121 may be press-fitted into an inner circumferential surface of the intermediate shell 111.

The rotor 122 may be rotatably inserted into the stator 121, and the rotational shaft 123 may be press-fitted into a center of rotation (or a rotation or rotational center) of the rotor 122. Accordingly, the rotational shaft 123 may rotate concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bearing portion 1312 to be described hereinafter and a second oil passage hole 126*b* belonging to a range of a sub bearing portion 1322. Each of the first oil passage hole 126*a* and the second oil passage hole 126*b* may be provided as one hole or as a plurality of holes. In this embodiment, each of the first and second oil passage holes is provided as a plurality.

An oil pump 127 may be installed at a middle or lower end of the oil flow path 125. A gear pump, a viscous pump, or a centrifugal pump may be used for the oil pump 127. This embodiment illustrates a case in which a centrifugal pump is employed. Accordingly, when the rotational shaft 123 rotates, oil filled in the oil storage space 110*b* is pumped by the oil pump 127 and is suctioned along the oil flow path 125, so as to be introduced to a sub bearing surface 1322*a* of the sub bearing portion 1322 through the second oil passage hole 126*b* and to a main bearing surface 1312*a* of the main bearing portion 1312 through the first oil passage hole 126*a*. This will be described hereinafter.

The compression unit 130 may include a main bearing 131, a sub bearing 132, a cylinder 133, a roller 134, and a plurality of vanes 135 (1351, 1352, and 1353). The main bearing 131 and the sub bearing 132 are respectively provided at upper and lower portions of the cylinder 133 to define a compression space V together with the cylinder 133, the roller 134 is rotatably installed in the compression space V, and the vanes 135 (1351, 1352, and 1353) are slidably inserted into the roller 134 to divide the compression space V into a plurality of compression chambers.

Referring to FIGS. 1 to 3, the main bearing 131 may be fixedly installed at the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 defines an upper surface of the compression space V, and supports an upper surface of the roller 134 in the axial direction and at the same time supports an upper portion of the rotational shaft 123 in a radial direction.

The main bearing 131 may include a main plate portion 1311 and main bearing portion 1312. The main plate portion 1311 covers an upper portion of the cylinder 133 to be coupled thereto, and the main bearing portion 1312 axially extends from a center of the main plate portion 1311 toward the drive motor 120 so as to support the upper portion of the rotational shaft 123.

The main plate portion 1311 may have a disk shape, and an outer circumferential surface of the main plate portion 1311 may be fixed to the inner circumferential surface of the intermediate shell 111 in a close contact manner. One or more discharge ports 1313 (1313*a*, 1313*b*, 1313*c*) may be defined in the main plate portion 1311, and a plurality of discharge valves 1361*a*, 1361*b*, and 1361*c* configured to open and close the respective discharge ports 1313*a*, 1313*b*, and 1313*c* may be installed on an upper surface of the main plate portion 1311, and a discharge muffler 137 having a discharge space (no reference numeral) may be provided at an upper portion of the main plate portion 1311 to accommodate the discharge ports 1313*a*, 1313*b* and 1313*c*, and the discharge valves 1361*a*, 1361*b*, and 1361*c*. Accordingly, refrigerant compressed in the compression unit 130 may be discharged to an inner space 110*a* of the casing 100 through the discharge ports 1313*a*, 1313*b* and 1313*c*, and the discharge muffler 137 and may then be discharged to a discharge pipe 116. As a result, the inner space 110*a* of the casing 110 may be maintained at a high pressure forming a discharge pressure.

The main bearing portion 1312 may be formed in the shape of a hollow bush, and an oil groove (not shown) may be formed on main bearing surface 1312*a* which is an inner circumferential surface of the main bearing portion 1312. The oil groove may extend linearly or diagonally between upper and lower ends of the main bearing portion 1312 to communicate with a second main back pressure pocket 1315*b* through a second main bearing protrusion 1316*b* described hereinafter.

The first main back pressure pocket 1315*a* and the second main back pressure pocket 1315*b* may be formed at a lower surface of the main plate portion 1311 facing the upper surface of the roller 134. The first main back pressure pocket 1315*a* and the second main back pressure pocket 1315*b* each having an arcuate shape may be disposed at a predetermined interval in a circumferential direction. The first main back pressure pocket 1315*a* and the second main back pressure pocket 1315*b* may each have an inner circumferential surface with a circular shape, but may each have an outer circumferential surface with an oval or elliptical shape in consideration of vane slots to be described hereinafter.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V. However, the first main back pressure pocket 1315*a* and the second main back pressure pocket 1315*b* may slightly communicate with each other through a gap between the lower surface of the main plate portion 1311 and the upper surface of the roller 134 facing each other unless a separate sealing member is provided therebetween.

The first main back pressure pocket 1315*a* forms a pressure lower than a pressure formed in the second main back pressure pocket 1315*b*, for example, an intermediate pressure between a suction pressure and a discharge pressure. Oil (refrigerant oil) may pass through a fine or tiny passage between a first main bearing protrusion 1316*a* described hereinafter and the upper surface of the roller 134 to be introduced into the main back pressure pocket 1315*a*. The first main back pressure pocket 1315*a* may be formed in a range of a compression chamber forming an intermediate pressure of the compression space V. This may allow the first main back pressure pocket 1315*a* to maintain the intermediate pressure.

Oil flowing into the main bearing surface 1312*a* of the main bearing 1312 described hereinafter through the first oil passage hole 126*a* may be introduced into the second main back pressure pocket 1315*b* through a main communication flow path (not shown). The second main back pressure pocket 1315*b* may be formed in a range of a compression chamber forming a discharge pressure of the compression space V. This may allow the second main back pressure pocket 1315*b* to maintain the discharge pressure.

In addition, the first main bearing protrusion 1316*a* and the second main bearing protrusion 1316*b* may be formed on inner circumferential sides of the first main back pressure pocket 1315*a* and the second main back pressure pocket 1315*b*, respectively, extending from the main bearing surface 1312*a* of the main bearing portion 1312. Accordingly, the inner circumferential sides of the first main back pressure pocket 1315*a* and the second main back pressure pocket 1315*b* may be separated from the main bearing surface 1312*a*, and an area that supports the rotational shaft 123 may be increased.

The first main bearing protrusion 1316*a* and the second main bearing protrusion 1316*b* may have a same height or different heights. For example, when the first main bearing protrusion 1316*a* and the second main bearing protrusion 1316*b* have the same height, an oil communication groove (not shown) or an oil communication hole (not shown) may be formed on an end surface of the second main bearing protrusion 1316*b* to allow inner and outer circumferential surfaces of the second main bearing protrusion 1316*b* to communicate with each other. Accordingly, high-pressure oil (refrigerant oil) flowing into the main bearing surface 1312*a* may be introduced into the second main back pressure pocket 1315*b* through the oil communication groove (not shown) or the oil communication hole (not shown).

On the other hand, when the first main bearing protrusion 1316*a* and the second main bearing protrusion 1316*b* have different heights, the height of the second main bearing protrusion 1316*b* may be lower than the height of the first main bearing protrusion 1316*a*. Accordingly, high-pressure oil (refrigerant oil) flowing into the main bearing surface 1312*a* may be introduced into the second main back pressure pocket 1315*b* by passing over the second main bearing protrusion 1316*b*.

Referring to FIGS. 1 to 3, the sub bearing 132 may be coupled to a lower end of the cylinder 133 in a close contact manner. Accordingly, the sub bearing 132 defines a lower surface of the compression space V, and supports a lower surface of the roller 134 in the axial direction and at the same time supports a lower portion of the rotational shaft 123 in the radial direction.

The sub bearing 132 may include a sub plate portion 1321 and sub bearing portion 1322. The sub plate portion 1321 may cover a lower portion of the cylinder 133 to be coupled to thereto, and the sub bearing portion 1322 may axially extend from a center of the sub plate portion 1321 toward the lower shell 112 so as to support the lower portion of the rotational shaft 123.

The sub plate portion 1321 may have a disk shape like the main plate portion 1311, and an outer circumferential surface of the sub plate portion 1321 may be spaced apart from the inner circumferential surface of the intermediate shell 111. The sub bearing portion 1322 may be formed in the shape of a hollow bush, and an oil groove (not shown) may be formed on sub bearing surface 1322*a* which is an inner circumferential surface of the sub bearing portion 1322. The oil groove may extend linearly or diagonally between upper and lower ends of the sub bearing portion 1322 to communicate with a second sub back pressure pocket 1325*b* through a second sub bearing protrusion 1326*b* described hereinafter. The first sub back pressure pocket 1325*a* and the second sub back pressure pocket 1325*b* may be formed on a lower surface of the sub plate portion 1321 facing the lower surface of the roller 134.

The first sub back pressure pocket 1325*a* and the first main back pressure pocket 1315*a* may be symmetric with respect to the roller 134, and the second sub back pressure pocket 1325*b* and the second main back pressure pocket 1315*b* may be symmetric with respect to the roller 134. For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other. Accordingly, a first sub bearing protrusion 1326*a* may be formed on an inner circumferential side of the first sub back pressure pocket 1325*a*, and the second sub bearing protrusion 1326*b* may be formed on an inner circumferential side of the second sub back pressure pocket 1325*b*.

Descriptions of the first sub back pressure pocket 1325*a* and the second sub back pressure pocket 1325*b*, and the first sub bearing protrusion 1326*a* and the second sub bearing protrusion 1326*b* may be the same as descriptions of the first main back pressure pocket 1315*b* and the second main back pressure pocket 1315*b*, and the first main bearing protrusion 1316*a* and the second main bearing protrusion 1316*b*, and repetitive description has been omitted.

Although not illustrated in the drawings, back pressure pockets [(1315*a*, 1315*b*) (1325*a*, 1325*b*)] may be provided only at any one of the main bearing 131 and the sub bearing 132.

The discharge port 1313 may be formed in the main bearing 131 as described above. However, the discharge port may be defined in the sub bearing 132, defined in each of the main bearing 131 and the sub bearing 132, or formed by penetrating between inner and outer circumferential surfaces of the cylinder 133. This embodiment describes an example in which the discharge ports are defined in the main bearing.

In addition, one discharge port 1313 may be provided. However, in this embodiment, a plurality of discharge ports 1313*a*, 1313*b*, and 1313*c* is formed at predetermined intervals along a compression proceeding direction (or a rotational direction of the roller).

In the case of the vane rotary compressor, the roller 134, in general, is eccentrically disposed with respect to the compression space V, such that a proximate point P1 at which an outer circumferential surface 1341 of the roller 134 and an inner circumferential surface 1331 of the cylinder 133 are almost in contact is generated, and the discharge port 1313 is formed near the proximate point P1. As the compression space V gets closer to the proximate point P1, a gap (or distance) between the inner circumferential surface 1331 of the cylinder 133 and the outer circumferential surface 1341 of the roller 134 becomes smaller (or narrower), making it difficult to secure the area of the discharge port.

Thus, as in this embodiment, the discharge port 1313 may be divided into a plurality of discharge ports 1313*a*, 1313*b*, and 1313*c* formed along the rotational direction of the roller 134 (or the compression proceeding direction). In addition, each of the plurality of discharge ports 1313*a*, 1313*b*, and 1313*c* may be provided as one, or a pair (a set of two).

For example, the discharge port 1313 according to this embodiment may be configured such that first discharge port 1313*a*, second discharge port 1313*b*, and third discharge port 1313*c* are arranged in the order of proximity to a proximal portion 1331*a* based on the rotational direction of the roller 134. A distance between the first discharge port 1313*a* and the second discharge port 1313*b* and/or a distance between the second discharge port 1313*b* and the third discharge port 1313*c* may be approximately similar to a distance between a preceding vane and a following vane, namely, a circumferential length of each compression chamber.

For example, the distance between the first discharge port 1313*a* and the second discharge port 1313*b*, which is a first distance, and the distance between the second discharge port 1313*b* and the third discharge port 1313*c*, which is a second distance, may be equal. The first distance and the second distance may be substantially equal to a circumferential length of a first compression chamber V1, a circumferential length of a second compression chamber V2, and a circumferential length of a third compression chamber V3. Accordingly, the first discharge port 1313*a* may communicate with the first compression chamber V1, the second discharge port 1313*b* may communicate with the compression chamber V2, and the third discharge port 1313*c* may communicate with the third compression chamber V3, rather than providing communication between a plurality of discharge ports 1313 and one compression chamber or between one discharge port 1313 and a plurality of compression chambers.

However, when vane slots 1342*a*, 1342*b*, and 1342*c* described hereinafter are disposed at unequal or irregular intervals, the compression chambers V1, V2, and V3 may have different circumferential lengths, such that one compression chamber may communicate with a plurality of discharge ports, or a plurality of compression chambers may communicate with one discharge port. This will be described hereinafter together with the vane slots.

In addition, a discharge groove 1314 may extend from the discharge port 1313 according to this embodiment. The discharge groove 1314 may extend in an arcuate shape along the compression proceeding direction (the rotational direction of the roller). Accordingly, refrigerant, which is not discharged from a preceding compression chamber, may be guided to a discharge port 1313 communicating with a following compression chamber through the discharge groove 1314, so as to be discharged together with refrigerant compressed in the following compression chamber. As a result, residual refrigerant in the compression space V may be minimized to thereby suppress over compression or excessive compression. Thus, efficiency of the compressor may be increased.

The discharge groove 1314 may extend from the last discharge port, for example, the third discharge port 1313. In the vane rotary compressor, as the compression space V is divided into a suction chamber and a discharge chamber with the proximal portion (proximate point) 1331*a* interposed therebetween, the discharge port 1313 cannot overlap the proximate point P1 located at the proximal portion 1331*a* in consideration of sealing between the suction chamber and the discharge chamber. Accordingly, a refrigerant remaining space S by which the inner circumferential surface 1331 of the cylinder 133 and the outer circumferential surface 1341 of the roller 134 are spaced apart is formed between the proximate point P1 and the discharge port 1313 along the circumferential direction, and refrigerant which is not discharged through the last discharge port 1313 remains in the refrigerant remaining space S. This residual refrigerant may increase pressure of the last compression chamber to thereby cause a decrease in compression efficiency due to over compression.

However, as in this embodiment, when the discharge groove 1314 extends from the last discharge port 1313 to the refrigerant remaining space S, refrigerant remaining in the refrigerant remaining space S may be discharged additionally by flowing back to the last discharge port 1313 through the discharge groove 1314, thereby suppressing a decrease in compression efficiency due to over compression in the last compression chamber.

Although not illustrated in the drawings, a residual refrigerant discharge hole may be defined in the refrigerant remaining space in addition to the discharge groove. The residual refrigerant discharge hole may have a smaller inner diameter than the discharge port. Unlike the discharge port, the residual refrigerant discharge hole may be configured to remain open at all times, rather than being opened and closed by the discharge valve.

In addition, the plurality of discharge ports 1313*a*, 1313*b*, and 1313*c* may be opened and closed by the discharge valves 1361*a*, 1361*b*, and 1361*c*, respectively. Each of the discharge valves 1361*a*, 1361*b*, and 1361*c* may be implemented as a cantilever type reed valve having one end defining a fixed end and another end defining a free end. These discharge valves 1361*a*, 1361*b*, and 1361*c* are widely known in the conventional rotary compressor, and thus, detailed description thereof has been omitted.

Referring to FIGS. 1 to 4, the cylinder 133 according to this embodiment may be in close contact with a lower surface of the main bearing 131 and coupled to the main bearing 131 by, for example, a bolt together with the sub bearing 132. Accordingly, the cylinder 133 may be fixedly coupled to the casing 110 by the main bearing 131.

The cylinder 133 may be formed in an annular shape having compression space V at its center, and the inner circumferential surface 1331 of the cylinder 133 defining the compression space V may have an elliptical shape. The inner circumferential surface 1331 of the cylinder 133 defining the compression space V may be eccentric with respect to a rotational center (or center of rotation) Or of the roller 134 defining an axial center (no numeral reference). The inner circumferential surface 1331 of the cylinder 133 will be described hereinafter.

The cylinder 133 may be provided with a suction port 1332 communicating with the compression space V. The suction port 1332 may be formed by penetrating from an outer circumferential surface of the cylinder 133 to the inner circumferential surface 1331 of the cylinder 133. The outer circumferential surface of the cylinder 133 at which the suction port 1332 is formed may be in close contact with an inner circumferential surface of the casing 110, allowing the suction pipe 115 formed through the casing 110 to be directly connected thereto. Accordingly, refrigerant may be directly suctioned into the compression space V through the suction port 1332.

In addition, the suction port 1332 may be formed at one side in the circumferential direction with respect to the proximate point P1 described hereinafter, namely, at an opposite side of the discharge port 1313 in the circumferential direction based on the proximate point P1. Accordingly, the suction port 1332 and the discharge port 1313 may be separated in the circumferential direction with respect to the proximate point P1.

The inner circumferential surface 1331 of the cylinder 133 according to this embodiment may have an elliptical shape. A plurality of ellipses may be combined to form an asymmetric elliptical shape biased or concentrated in a specific direction.

The inner circumferential surface 1331 of the cylinder 133 may include the proximal portion 1331*a*, a distal (or remote) portion 1331*b*, and a curved portion 1331*c*. The proximal portion 1331*a* is a portion which is closest to the outer circumferential surface (or the rotational center of the roller) 1341 of the roller 134, the distal portion 1331*b* is a portion which is farthest away from the outer circumferential surface 1341 of the roller 134, and the curved portion 1331*c* is a portion connecting the proximal portion 1331*a* and the distal portion 1331*b*.

The proximal portion 1331*a* may also be defined as the proximate point P1, and the suction port 1332 and the discharge port 1313 may be provided at both sides with respect to the proximal portion 1331*a*. For example, the suction port 1332 may be formed at one or a first side in the circumferential direction with respect to the proximal portion 1331*a*, and the discharge port 1313 may be formed at another or a second side in the circumferential direction with respect to the proximal portion 1331*a*.

The distal portion 1331*b* may extend in a specific direction to be formed convexly. For example, the distal portion 1331*b* is a portion at which two ellipses having largest aspect ratios meet. Accordingly, an inflection point P2 on the distal portion 1331*b* has a greatest curvature change compared to inflection points on other portions of the inner circumferential surface 1331 of the cylinder 133. Hereinafter, an inflection point may be referred to as the inflection point P2 on the distal portion 1331*b*. The inflection point P2 in a broader sense may be understood as the distal portion 1331*b* including the inflection point P2.

The curved portion 1331*c* may be formed as a plurality of elliptical surfaces having different aspect ratios and disposed asymmetrically with respect to a first center line CL1 and a second center line CL2. Hereinafter, the first center line CL1 may be referred to as a virtual line that passes through the rotational center Or of the roller 134 and the proximate point P1, and the second center line CL2 may be referred to as a virtual line that passes through the rotational center Or of the roller 134 and is orthogonal to the first center line CL1.

For example, based on the compression proceeding direction (rotational direction of the roller), the curved portion 1331*c* may include a first curved portion 1331*c*1 which is from the proximal portion (more precisely, the proximate point) 1331*a* to the distal portion (more precisely, the inflection point) 1331*b*, a second curved portion 1331*c*2 which is from the distal portion 1331*b* to the first center line CL1, a third curved portion 1331*c*3 which is from the first center line CL1 to the second center line CL2, and a fourth curved portion 1331*c*4 which is from the second center line CL2 to the proximal portion, that is, the first center line, 1331*a*.

The first curved portion 1331*a*1 may have the largest aspect ratio. Accordingly, an inflection point between the first curved portion 1331*c*1 and the second curved portion 1331*c*2, which is the inflection point P2, may have a larger curvature change than an inflection point between the second curved portion 1331*c*2 and the third curved portion 1331*c*3, an inflection point between the third curved portion 1331*c*3 and the fourth curved portion 1331*c*4, and an inflection point between the fourth curved portion 1331*c*4 and the first curved portion 1331*c*1. Therefore, as described above, the largest inflection point P2 may be formed between the first curved portion 1331*c*1 and the second curved portion 1331*c*2, namely, at the distal portion 1331*b*.

Referring to FIGS. 1 to 4, the roller 134 may be rotatably disposed in the compression space V of the cylinder 133, and the plurality of vanes 1351, 1352, and 1353 described hereinafter may be inserted into the roller 134 at predetermined intervals in the circumferential direction. The compression space V may be divided into a plurality of compression chambers as many as the number of vanes 1351, 1352, and 1353. This embodiment describes an example in which three vanes 1351, 1352, and 1353 are provided and the compression space V is divided into three compression chambers.

The outer circumneutral surface 1341 of the roller 134 according to this embodiment may have a circular shape, and the rotational shaft 123 may be coupled to the rotational center Or of the roller 134. Accordingly, the rotational center Or of the roller 134 is located on a same axis as an axial center (no reference numeral) of the rotational shaft 123, and the roller 134 rotates concentrically with the rotational shaft 123.

However, as described above, as the inner circumferential surface 1331 of the cylinder 133 is formed in the asymmetric elliptical shape biased in a specific direction, the rotational center Or of the roller 134 may be disposed eccentric with respect to a geometrical center of an inner space of the cylinder 133, that is, the compression space, namely, an outer diameter center (a center of an outer diameter) Oc of the cylinder 133. Accordingly, one side of the outer circumferential surface 1341 of the roller 134 is almost in contact with the inner circumferential surface 1331 of the cylinder 133, more precisely, the proximal portion 1331*a* to thereby form the proximate point P1.

The proximate point P1 may be defined in the proximal portion 1331*a* as described above. Accordingly, the first center line CL1 passing through the proximate point P1 may correspond to a minor axis of an elliptic curve defining the inner circumferential surface 1331 of the cylinder 133.

A plurality of vane slots 1342*a*, 1342*b*, and 1342*c* may be defined in the outer circumferential surface 1341 of the roller 134 along the circumneutral direction at appropriate locations, and the plurality of vanes 1351, 1352, and 1353 to be described hereinafter may be slidably inserted into the plurality of vane slots 1342*a*, 1342*b*, and 1342*c*, respectively.

The plurality of vane slots 1342*a*, 1342*b*, and 1342*c* may be defined as a first vane slot 1342*a*, a second vane slot 1342*b*, and a third vane slot 1342*c* along the compression proceeding direction (rotational direction of the roller), and the first vane slot 1342*a*, the second vane slot 1342*b*, and the third vane slot 1342*c* may be identical. Each of the plurality of vane slots 1342*a*, 1342*b*, and 1342*c* may be inclined by a predetermined angle with respect to the radial direction to thereby secure sufficient lengths for the vanes 1351, 1352, and 1353.

As the inner circumferential surface 1331 of the cylinder 133 is formed in the asymmetric elliptical shape, separation of the vanes 1351, 1352, and 1353 from the respective vane slots 1342*a*, 1342*b*, and 1342*c* may be suppressed even when a distance between the outer circumferential surface 1341 of the roller 134 and the inner circumferential surface 1331 of the cylinder 133 increases, thereby increasing a degree of design freedom for the inner circumferential surface 1331 of the cylinder 133.

A direction in which the vanes 1351, 1352 and 1353 are tilted may be an opposite direction to the rotational direction of the roller 134. That is, front surface of the vanes 1351, 1352, and 1353 in contact with the inner circumferential surface 1331 of the cylinder 133 may be tilted in the rotational direction of the roller 134, which allows a compression start angle to be formed ahead in the rotational direction of the roller 134 so that compression may start quickly.

Back pressure chambers 1343*a*, 1343*b*, and 1343*c* may be formed at inner ends of the vane slots 1342*a*, 1342*b*, and 1342*c*, respectively, in a communicating manner. Oil (or refrigerant) with the discharge pressure or intermediate pressure may be accommodated in the back pressure chambers 1343*a*, 1343*b*, and 1343*c* to introduce the oil at or to rear sides of the vanes 1351, 1352, and 1353, namely, vane rear end portions 1351*c*, 1352*c*, and 1353*c*, such that each of the vanes 1351, 1352, and 1353 may be pushed toward the inner circumferential surface 1331 of the cylinder 133 by pressure of the oil (or refrigerant) filled in the back pressure chambers 1343*a*, 1343*b*, and 1343*c*. For the sake of convenience, a direction toward the cylinder with respect to a motion direction of the vane will be referred to as a front side, and an opposite direction will be referred to as a rear side.

The back pressure chambers 1343*a*, 13343*b*, and 1343*c* may be hermetically sealed by the main bearing 131 and the sub bearing 132. The back pressure chambers 1343*a*, 1343*b*, and 1343*c* may independently communicate with the back pressure pockets [(1315*a*, 1315*b*) (1325*a*, 1325*b*)], or the back pressure chambers 1343*a*, 13343*b*, and 1343*c* may communicate to each other through the back pressure pockets [(1315*a*, 1315*b*) (1325*a*, 1325*b*)].

Referring to FIGS. 1 to 3, the plurality of vanes 1351, 1352, and 1353 according to this embodiment may be slidably inserted into the respective vane slots 1342*a*, 1342*b*, and 1342*c*. Accordingly, the plurality of vanes 1351, 1352, and 1353 may have substantially a same shape as the vane slots 1342*a*, 1342*b*, and 1342*c*, respectively.

For example, when the plurality of vanes 1351, 1352, and 1353 is referred to as a first vane 1351, a second vane 1352, and a third vane 1353 along the rotational direction of the roller 134, the first vane 1351 may be inserted into the first vane slot 1342*a*, the second vane 1352 may be inserted into the second vane slot 1342*b*, and the third vane 1353 may be inserted into the third vane slot 1342*c*. The plurality of vanes 1351, 1352, and 1353 may have substantially the same shape. More specifically, the plurality of vanes 1351, 1352, and 1353 may include vane bodies 1351*a*, 1352*a* and 1353*a*, vane front end portions (or front surfaces) 1351*b*, 1352*b* and 1353*b*, and vane rear end portions (or rear surfaces) 1351*c*, 1352*c* and 1353*c*, respectively. The vane front end portions 1351*b*, 1352*b*, and 1353*b* may be understood as surfaces in contact with the inner circumferential surface 1331 of the cylinder 133, and the vane rear end portions 1351*c*, 1352*c*, and 1353*c* may be understood as surfaces facing the back pressure chambers 1343*a*, 1343*b*, and 1343*c*.

Each of the vane bodies 1351*a*, 1352*a*, and 1353*a* may be formed in a substantially cuboid shape. Accordingly, the vane bodies 1351*a*, 1352*a*, and 1353*a* may smoothly slide along lengthwise (or longitudinal) directions of the vane slots 1342*a*, 1342*b*, and 1342*c*, respectively.

The vane front end portions 1351*b*, 1352*b*, and 1353*b* may be curved to be in line contact with the inner circumferential surface 1331 of the cylinder 133. The vane rear end portions 1351*c*, 1352*c*, and 1353*c* may be flat to be inserted into the back pressure chambers 1342*a*, 1342*b*, 1342*c* to thereby evenly receive a back pressure.

The vane front end portions 1351*b*, 1352*b*, and 1353*b* may be formed by curvedly chamfering an edge on a downstream side located opposite to the rotational direction of the roller 134 of both edges in the circumferential direction. However, in some cases, both edges of each of the vane front end portions 1351*b*, 1352*b*, and 1353*b* may be curvedly chamfered to form a semicircle, or formed in a substantially right angle without being chamfered.

In addition, the vane rear end portions 1351*c*, 1352*c*, and 1353*c* may be formed flat to be orthogonal to lengthwise directions of the vanes 1351, 1352, and 1353, respectively. However, as in this embodiment, one edge of each of the vane rear end portions 1351*c*, 1352*c*, and 1353*c* may be chamfered to have an inclined surface or a stepped surface. This will be described hereinafter.

In the vane rotary compressor having the hybrid cylinder, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the vanes 1351, 1352, and 1353 are drawn (or pulled) out from or inserted into the respective vane slots 1342*a*, 1342*b*, and 1342*c* by a centrifugal force generated when the roller 134 rotates and back pressures of the back pressure chambers 1343*a*, 1343*b*, and 1343*c* provided at the rear side of the vanes 1351, 1352, and 1353. Accordingly, the vane front end portions 1351*b*, 1352*b*, and 1353*b* are brought into contact with the inner circumferential surface 1331 of the cylinder 133.

The compression space V of the cylinder 133 is divided by the plurality of vanes 1351, 1352, and 1353 into the plurality of compression chambers (including a suction chamber or a discharge chamber) V1, V2, and V3 as many as the number of vanes 1351, 1352, and 1353. A volume of each compression chamber V1, V2, and V3 changes according to a shape of the inner circumferential surface 1331 of the cylinder 133 and eccentricity of the roller 134 while moving in response to rotation of the roller 134. Refrigerant introduced into each of the compression chambers V1, V2, and V3 flows along the roller 134 and the vanes 1351, 1352, and 1353, is compressed, and is then discharged into the inner space of the casing 110. Such series of processes are repeated.

At this time, the plurality of vanes 1351, 1352, and 1353 are drawn out from the vane slots 1342*a*, 1342*b*, and 1342*c* of the roller 134, respectively, and the vane front end portions 1351*b*, 1352*b*, and 1353*b* defining the front surfaces of the respective vanes 1351, 1352, and 1353 are brought into contact with the inner circumferential surface 1331 of the cylinder 133. However, as the vanes 1351, 1352, and 1353 are supported by unstable oil pressures of the back pressure chambers 1343*a* and 1343*b*, and 1343*c*, abnormal noise in a specific band is generated in a specific area of the inner circumferential surface 1331 of the cylinder 133.

When the inner circumferential surface of the cylinder 133 is formed in the asymmetric elliptical shape biased in a specific direction, the largest inflection point (the inflection point P2) is formed at the distal portion 1331*b* which is farthest away from the rotational center Or of the roller 134, and the vane front end portions 1351*b*, 1352*b*, and 1353*b* passing through the inflection point P2 sequentially collide with the inner circumferential surface 1331 of the cylinder 133 to thereby periodically generate a strong impulse sound. Due to the periodicity of the impulse sound, noise in a specific (frequency) band increases to thereby increase noise of the compressor. By appropriately adjusting intervals (or distances) of the vane slots or the vanes respectively inserted into the vane slots as in this embodiment, the periodicity of the impulse sound may be reduced. As a result, noise of the compressor may be reduced.

Figure 5:
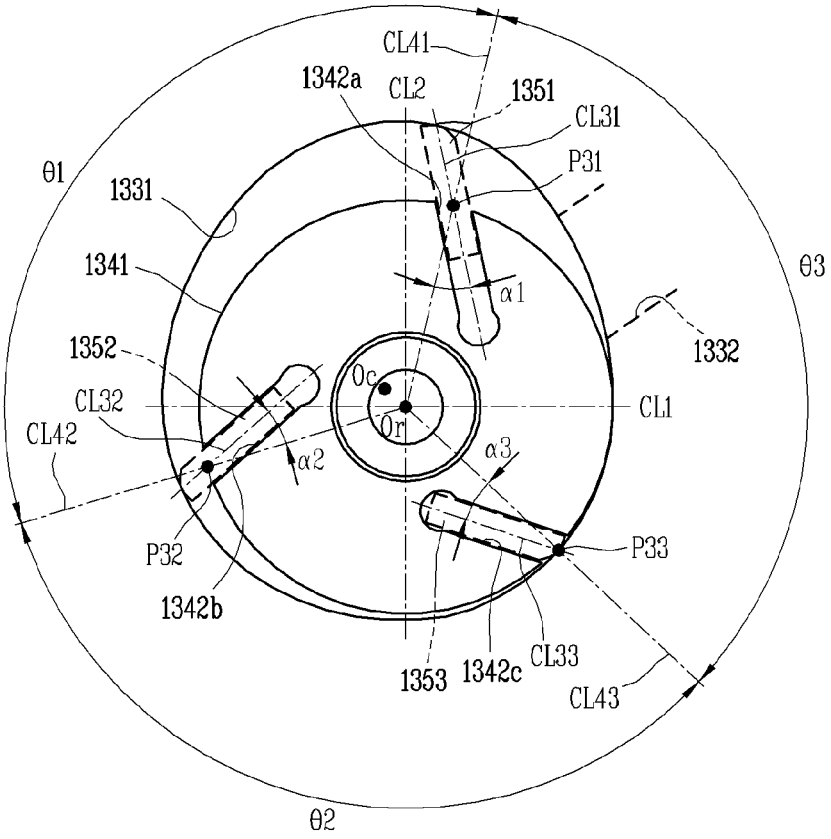
FIG. 5 is a schematic view illustrating an example of intervals between vane slots according to an embodiment.
Figure 6:
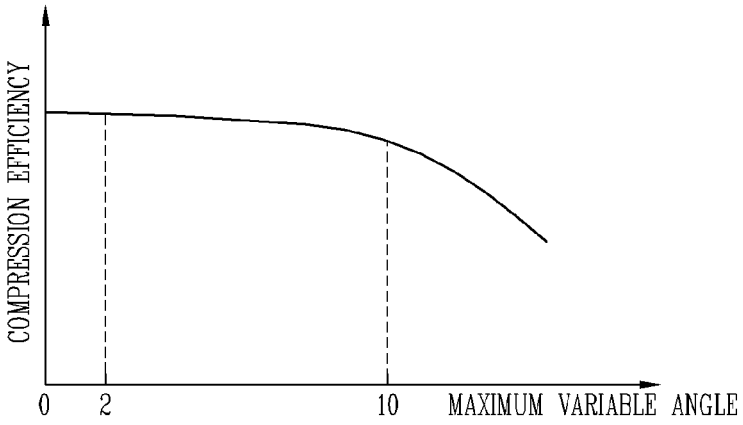
FIG. 6 is a graph showing comparison of compressor efficiency according to maximum variable angles in the embodiment of FIG. 5.

FIG. 5 is a schematic view illustrating intervals between vane slots according to an embodiment. FIG. 6 is a graph showing comparison of compressor efficiency according to maximum variable angles in embodiment of FIG. 5.

Referring to FIG. 5, the plurality of vane slots 1342*a*, 1342*b*, and 1342*c* according to this embodiment may be inclined with respect to the radial direction as described above. The plurality of vane slots 1342*a*, 1342*b*, and 1342*c* may be formed such that at least a portion (one or two) of angles θ1, θ2, and θ3 respectively formed between two adjacent virtual lines, of virtual lines CL41, CL42, and CL43 respectively connecting entry points P31, P32, and P33 of the respective vane slots 1342*a*, 1342*b*, and 1342*c* located on the outer circumferential surface and the rotational center Or of the roller 134, is different. Accordingly, the plurality of vane slots 1342*a*, 1342*b*, and 1342*c* adjacent to one another may be disposed at unequal intervals.

For example, when three vane slots 1342*a*, 1342*b*, and 1342*c* are formed along the circumferential direction, the angles θ1, θ2, and θ3 respectively formed between two adjacent vane slots may vary. For the sake of convenience, an angle between the first vane slot 1342*a* and the second vane slot 1342*b* will be referred to as a first angle θ1, an angle between the second vane slot 1342*b* and the third vane slot 1342*c* will be referred to as a second angle θ2, and an angle between the third vane slot 1342*c* and the first vane slot 1342*a* will be referred to as a third angle θ3.

The first angle θ1 may be greater or less than the second angle θ2, and greater or less than the third angle θ3. The second angle θ2 may be greater or less than the third angle θ3.

The first angle θ1, the second angle θ2, and the third angle θ3 may be different from one another. However, in some cases, one angle may be different from the rest. This embodiment illustrates an example in which the first angle θ1, the second angle θ2, and the third angle θ3 are different from each other.

The number of the angles (first angle θ1, second angle θ2, third angle θ1) may be determined by the number of vane slots (1342*a*, 1342*b*, 1342*c*), namely, the number of vanes (1351, 1352, 1353) respectively inserted into the vane slots (1342*a*, 1342*b*, 1342*c*).

For example, if three vane slots 1342*a*, 1342*b*, and 1342*c* are provided, three vanes 1351, 1352, and 1353 may be provided, and the three vanes 1351, 1352, and 1353 may be deposed at unequal intervals in the circumferential direction. Accordingly, vanes adjacent to each other pass through any one crank angle, for example, the inflection point P2 at a different time interval. Then, the periodicity of impulse sound, due to collision with the inner circumferential surface 1331 of the cylinder 133 when the vanes 1351, 1352, and 1353 pass through the inflection point P2, may be reduced, allowing noise in a specific band to be reduced.

The plurality of vane slots 1342*a*, 1342*b*, and 1342*c* may be inclined with respect to the radial direction, disposed at the unequal intervals, and have longitudinal centers CL31, CL32, and CL33 that intersect the virtual lines CL41, CL42, and CL43, respectively, at the same angle.

In other words, an inclination angle α1 of the vane slot 1342*a*, an inclination angle α2 of the vane slot 1342*b*, and an inclination angle α3 of the vane slot 1342*c* may be equal to one another. Accordingly, the plurality of vane slots 1342*a*, 1342*b*, and 1342*c* may be disposed at the unequal intervals, and the center of gravity of the roller including the vanes may be maintained almost nearly the same as the rotational center Or of the roller 134. Thus, an eccentric load due to the unequally spaced vane slots may be suppressed.

However, the inclination angles α1, α2, and α3 of the plurality of vane slots 1342*a*, 1342*b*, and 1342*c* are not necessarily equal. For example, among the inclination angles α1, α2, and α3 of the plurality of vane slots 1342*a*, 1342*b*, and 1342*c*, at least one of the inclination angles α1, α2, and α3 may be different. However, even in this case, the center of gravity of the roller including the vanes should be maintained almost nearly the same as the rotational center Or of the roller 134 in order to suppress the eccentric load caused by the unequally spaced vane slots.

In terms of compressor efficiency, the plurality of vane slots 1342*a*, 1342*b*, and 1342*c* may be formed such that an interval (angle) between two vane slots adjacent to each other in the circumferential direction is disposed within an appropriate range. For example, if the interval between two adjacent vane slots is too small, the effect of reducing the periodicity of impulse sound may be decreased, whereas if the interval between two adjacent vane slots is too large, a volume difference between chambers may be increased to thereby reduce compressor efficiency. Accordingly, an interval between two adjacent vanes, namely, each of the angles θ1, θ2, and θ3 may be formed in a range that can minimize a decrease in compressor efficiency and reduce the periodicity of impulse sound, that is, a maximum variable angle is formed to satisfy a specific range.

In other words, the interval between two vane slots, namely, the angles θ1, θ2, and θ3 between each of two adjacent vane slots may be defined by the following [Equation 1].

$$\theta_i' = \theta_i + \Delta\theta \times \mathrm{Sin}(m \times \theta_i) \quad \text{[Equation 1]}$$

where, $\theta_i'$ denotes a rearrangement angle of vane slots, $\theta_i$ denotes an equal interval angle, Δθ denotes a maximum variable angle, and m denotes the order (or sequence) of vanes. The maximum variable angle (Δθ) may be defined as 2 to 10°. As can be seen from FIG. 6, the compressor efficiency may be the highest at 0° when the interval between the vane slots 1342*a*, 1342*b*, and 1342*c* is 0°, and the compressor efficiency may decrease with an increase in the interval between the vane slots 1342*a*, 1342*b*, and 1342*c*. However, it can be seen that the compressor efficiency gradually decreases up to approximately 10°, and then drops rapidly after reaching 10°. Therefore, the maximum variable angle (Δθ) may be in the range of 2 to 10°.

When applying [Equation 1] to the embodiment of FIG. 5, and setting the maximum variable angle (Δθ) to 6°, the first angle may be approximately 125.2°, the second angle may be 114.8°, and the third angle may be 120.0°. When the intervals between the vanes (or vane slots) 1351, 1352, and 1353 are different from each other, a time difference occurs between the vanes 1351, 1352, and 1353 when passing through the inflection point P2. Then, the periodicity of impulse sound generated at the inflection point P2 may be reduced to thereby reduce the compressor noise in overall. In particular, as noise in a specific band is reduced, the compressor noise may be further reduced.

Figure 7:
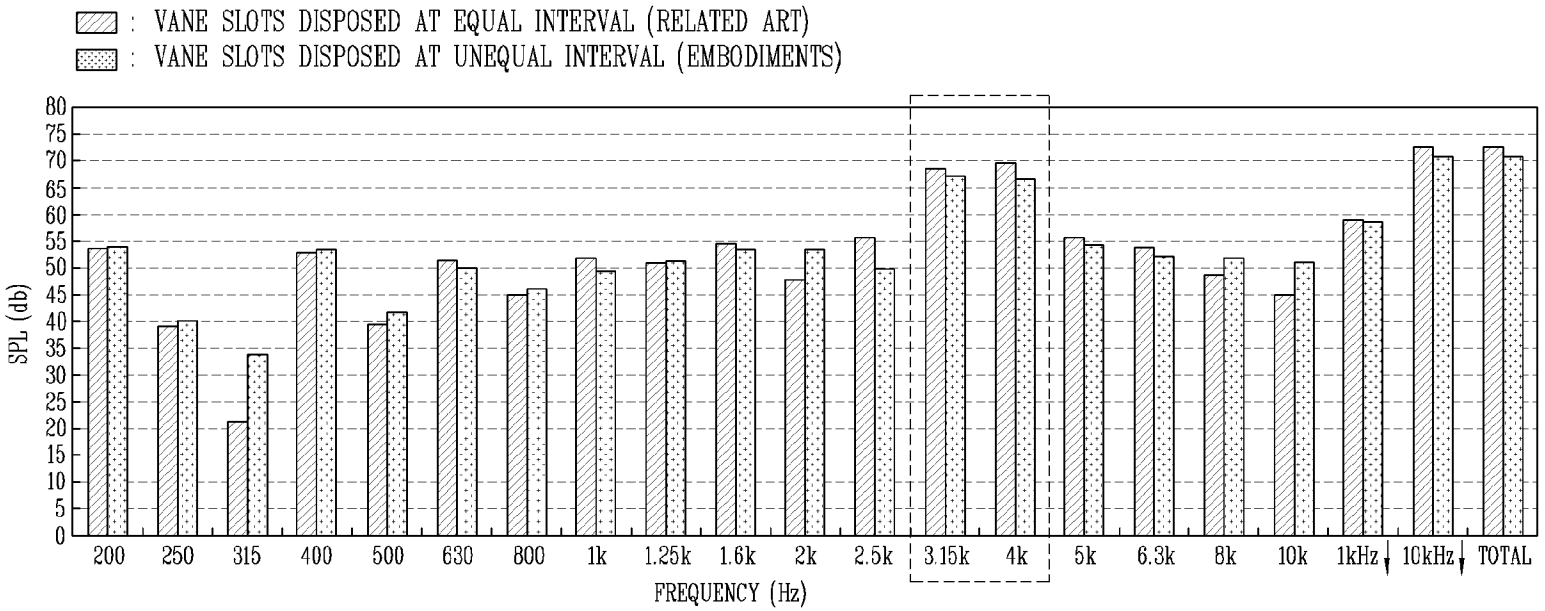
FIG. 7 is a graph showing comparison between vane slots disposed at unequal intervals according to embodiments and vane slots disposed at equal intervals.

FIG. 7 is a graph showing comparison between vane slots disposed at unequal intervals according to embodiments and vane slots disposed at equal intervals. Referring to FIG. 7, it can be seen that noise of a vane rotary compressor (dot hatching) in which unequally spaced vane slots 1342*a*, 1342*b*, and 1342*c* according to embodiments are employed exhibits lower noise in overall than a vane rotary compressor (slash hatching) in which equally spaced vane slots are employed.

In particular, it can be seen that a sharp pure tone (impulse sound at the inflection point is significantly included) in the 3 to 4 kHz band, which is the main noise band range, was reduced by about 5 dB, and noise was reduced by about 2.5 dB in terms of the overall noise level below 10 kHz. This is a component evaluation for a flange sample with a thick compressor outer wall. Therefore, when applied to an actual compressor with a relatively thin outer wall, a greater effect of noise reduction may be expected.

Hereinafter, another embodiment of a vane will be described.

That is, in previous embodiment, the vane rear end portion defining the rear surface of the vane is formed as a flat surface orthogonal to the lengthwise direction of the vane. However, in some cases, a chamfer (or chamfered) portion may be formed at one edge of the vane rear end portion.

Figure 8:
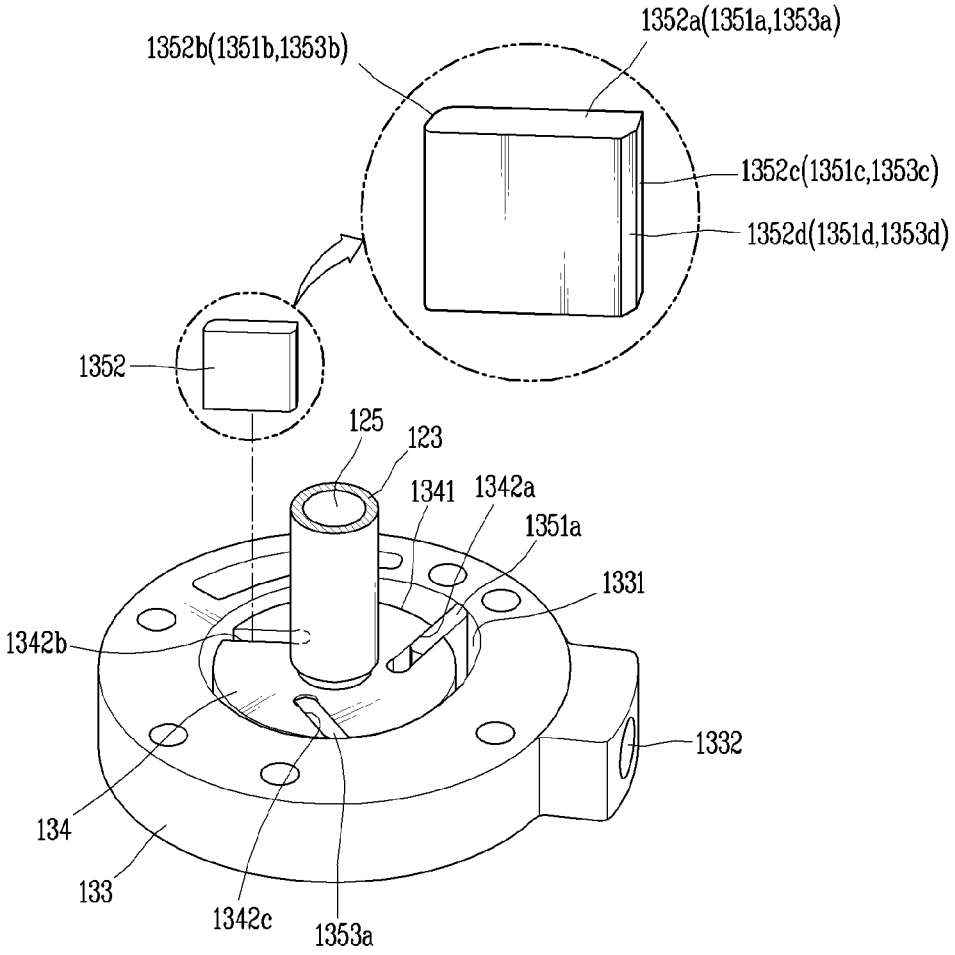
FIG. 8 is a perspective view of a vane according to an embodiment.
Figure 9:
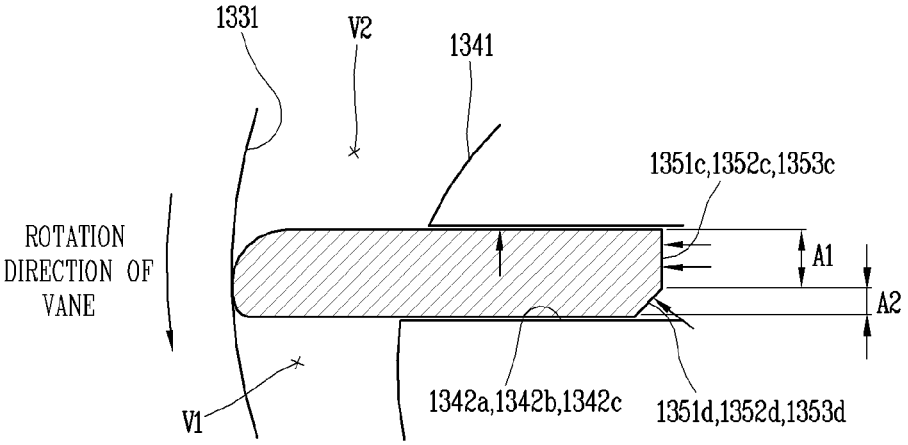
FIG. 9 is a planar view illustrating a state in which the vane of FIG. 8 is inserted into a vane slot.
Figure 10:
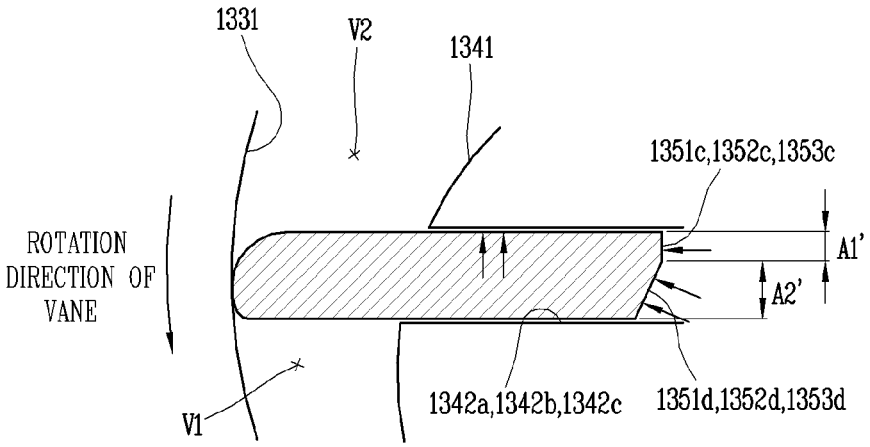
FIG. 10 is a planar view of a chamfer portion according to an embodiment.

FIG. 8 is a perspective view of a vane according to another embodiment. FIG. 9 is a planar view illustrating a state in which the vane of FIG. 8 is inserted into a vane slot. FIG. 10 is a planar view of a chamfer portion according to an embodiment.

Referring to FIGS. 8 and 9, vanes 1351, 1352, and 1353 according to this embodiment may be formed similar to the vanes 1351, 1352, and 1353 described in the previous embodiment. However, the vanes 1351, 1352, and 1353 according to this embodiment may have chamfer portions 1351*d*, 1352*d*, and 1353*d*, respectively. Each of the chamfer portions 1351*d*, 1352*d*, and 1353*d* may be formed on one edge at a side in the compression proceeding direction (rotational direction of the roller) of two edges of the respective vane rear end portions 1351*c*, 1352*c*, and 1353*c*.

The chamfer portions 1351*d*, 1352*d*, and 1353*d* may be formed in an inclined manner, as shown in FIG. 9, or formed in a stepped manner although not shown. Accordingly, each of the vanes 1351, 1352, and 1353 receives a plurality of components of force by oil (or refrigerant) accommodated in the back pressure chambers 1343*a*, 1343*b*, and 1343*c*. That is, the vanes 1351, 1352, and 1353 not only receive a first pressure at the vane rear end portions 1351*c*, 1352*c*, and 1353*c* in the lengthwise direction thereof, but also receive a second pressure at the chamfer portions 1351*d*, 1352*d*, and 1353*d* in a direction intersecting the lengthwise direction. The second pressure acts in a direction opposite to a direction in which the vanes 1351, 1352, and 1353 rotate.

Then, even when a side (or lateral) gap is generated between the vane (1351, 1352, 1353) and the vane slot (1342*a*, 1342*b*, 1342*c*) into which the vane is inserted, the vane (1351, 1352, 1353) may be supported by being pressed against an inner surface of the vane slot (1342*a*, 1342*b*, 1342*c*) by the second pressure. Accordingly, trembling or shaking of the vanes 1351, 1352, and 1353 generated as the vanes 1351, 1352, and 1353 are inserted into and pulled out (or enter and exit) from the respective vane slots 1342*a*, 1342*b*, and 1342*c* may be suppressed to thereby reduce noise of the vanes 1351, 1352, and 1353 caused by the shaking. As a result, noise of the compressor may be further reduced.

The chamfer portions 1351*d*, 1352*d*, and 1353*d* may each have a cross-sectional area A2 in a widthwise direction that is less than or equal to a cross-sectional area A1 of each of the vane rear end portions 1351*c*, 1352*c*, and 1353*c* in a widthwise direction. Alternatively, the cross-sectional area A2 of each of the chamfer portions 1351*d*, 1352*d*, and 1353*d* in the widthwise direction may be greater than or equal to the cross-sectional area A1 of each of the vane rear end portions 1351*c*, 1352*c*, and 1353*c* in the widthwise direction. The cross-sectional area A2 of each of the chamfer portions 1351*d*, 1352*d*, and 1353*d* in the widthwise direction may be a cross-sectional area excluding the cross-sectional area A1 of each of the rear end portions 1351*c*, 1352*c*, and 1353*c* in the widthwise direction of a cross-sectional area of each of the vane bodies 1351*a*, 1352*a*, and 1353*a* in the widthwise direction.

The cross-sectional areas A2 of the chamfer portions 1351*d*, 1352*d*, and 1353*d* in the widthwise direction may be selectively determined according to dimensions of the vane rotary compressor or a type of refrigerant. For example, referring to FIG. 9, in the case of a compressor operating at a low speed, the cross-sectional area A2 of the chamfer portion (1351*d*, 1352*d*, 1353*d*) in the widthwise direction may be less than or equal to the cross-sectional area A1 of the vane rear end portion (1351*c*, 1352*c*, 1353*c*). That is, a centrifugal force applied to the vanes 1351, 1352, and 1353 in the compressor operating at the low speed is reduced compared to a compressor operating at a high speed. Accordingly, it may be advantageous to reduce the second pressure acting in a direction that intersects the centrifugal force of each of the vanes 1351, 1352, and 1353.

The vanes 1351, 1352, and 1353 according to this embodiment may be formed such that the cross-sectional areas A2 of the chamfer portions 1351*d*, 1352*d*, and 1353*d* are less than or equal to the cross-sectional areas A1 of the vane rear end portions 1351*c*, 1352*c*, and 1353*c*. As the vane rear end portions 1351*c*, 1352*c*, and 1353*c* of the vanes 1351, 1352, and 1353 are formed larger, the first pressure is greatly applied even when the vanes 1351, 1352, and 1353 receive a small centrifugal force due to low-speed rotation of the roller 134. This may allow the vanes 1351, 1352, and 1353 to be in close contact with the inner circumferential surface 1331 of the cylinder 133 to thereby effectively seal between compression chambers even during low-speed operation. As a result, shaking of the vanes may be reduced to thereby reduce the noise of the compressor. Further, compression loss may be reduced to thereby increase the efficiency of the compressor.

This may be equally applicable to a compressor using a high-pressure refrigerant. That is, when the high-pressure refrigerant is used, a pressure difference between compression chambers is greater than when a low-pressure refrigerant is used. Accordingly, a relatively high pressure may be required to allow the vanes 1351, 1352, and 1353 to be in close contact with the cylinder 133 for suppressing leakage between the compression chambers. Therefore, even in this case, the cross-sectional areas A2 of the chamfer portions 1351*d*, 1352*d*, and 1353*d* may be greater than or equal to the cross-sectional areas A1 of the vane rear end portions 1351*c*, 1352*c*, and 1353*c*, so as to allow the vanes 1351, 1352, and 1353 to be in close contact with the cylinder 133 to thereby effectively reduce leakage between the compression chambers. As a result, shaking of the vanes 1351, 1352, and 1353 may be reduced, compressor noise and compression loss may be reduced. This may lead to an increase in efficiency of the compressor.

On the other hand, referring to FIG. 10, in the case of a compressor operating at a high speed, a cross-sectional area A2' of each of chamfer portions 1351*d*, 1352*d*, and 1353*d* in a widthwise direction may be greater than or equal to a cross-sectional area A1' of each of vane rear end portions 1351*c*, 1352*c*, and 1353*c* in the widthwise direction. That is, during the high-speed operation, as the vanes 1351, 1352, and 1353 receive a strong centrifugal force, the cross-sectional areas of the chamfer portions 1351*d*, 1352*d*, and 1353*d* in the widthwise direction may be greater than or equal to the cross-sectional areas of the vane rear end portions 1351*c*, 1352*c*, and 1353*c* in the widthwise direction so that the second pressure acting in a direction intersecting the centrifugal force may be widely applied as possible. This may result in suppressing excessive contact of the vanes 1351, 1352, and 1353 with the cylinder 133 to thereby reduce noise of the compressor as well as motor loss.

This may be equally applicable to a compressor using a low-pressure refrigerant. That is, when the low-pressure refrigerant is used, a pressure difference between compression chambers is less (smaller) than when a high-pressure refrigerant is used. Even when the vanes 1351, 1352, and 1353 are brought into close contact with the cylinder 133 by a relatively low pressure, leakage between the compression chambers may be suppressed. Accordingly, the cross-sectional area A2' of each of the chamfer portions 1351*d*, 1352*d*, and 1353*d* may be greater than or equal to the cross-sectional area A1' of each of the vane rear end portions 1351*c*, 1352*c*, and 1353*c* to reduce noise of the compressor. Thus, shaking of the vanes 1351, 1352, and 1353 may be reduced to thereby reduce noise of the compressor. Further, motor loss may be reduced to thereby increase the efficiency of the compressor.

Although not illustrated in the drawings, the chamfer portion formed at the vane rear end portion may be equally applied to an example in which one vane is provided. Even in this case, as the basic configuration and effect of the chamfer portion is the same as those of the embodiment having the plurality of vanes, detailed description thereof has been omitted.

The unequally spaced vane slots according to this embodiment may also be applied to a cylinder having an inner circumferential surface with a symmetric elliptical shape.

Figure 11:
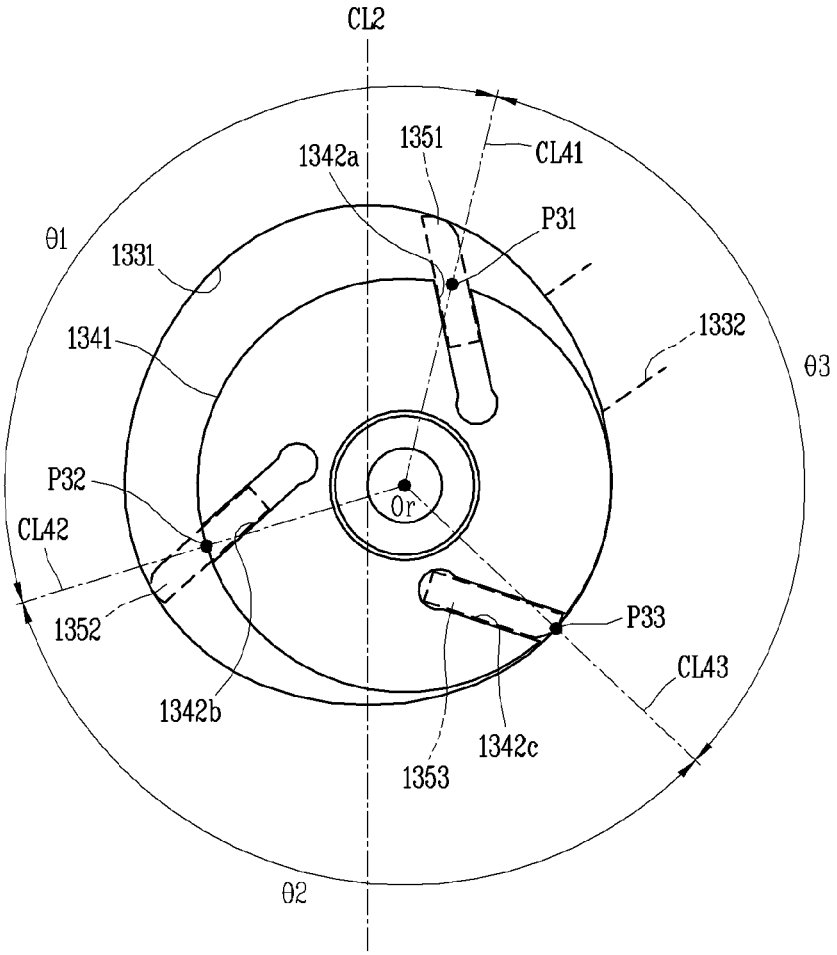
FIG. 11 is a planar view illustrating an example in which unequally spaced vane slots are employed in a cylinder having a symmetric elliptical shape according to an embodiment.

FIG. 11 is a planar view illustrating an example in which unequally spaced vane slots are employed in cylinder having a symmetric elliptical shape according to an embodiment. Referring to FIG. 11, inner circumferential surface 1331 of cylinder 133 according to this embodiment may be formed such that a plurality of ellipses are symmetrical to each other based on one center line, for example, a second center line CL2. For example, the inner circumferential surface 1331 of the cylinder 133 may extend lengthwise to one side, and the extended portion may be symmetrical with respect to the second center line CL2.

Even in this case, rotational center Or of roller 134 may be located on a same axis as an axial center (no reference numeral) of rotational shaft 123, but may be eccentric with respect to outer diameter center Oc of the cylinder 133. Like the previous embodiment, the inner circumferential surface 1331 of the cylinder 133 of this embodiment may have proximal portion 1331*a*, distal portion 1331*b* and curved portion 1331*c*, and proximate point P1 and inflection point P2 may be formed at the proximal portion 1331*a* and the distal portion 1331*b*, respectively.

Even when the inner circumferential surface 1331 of the cylinder 133 is formed in the symmetric elliptical shape, configurations and effects of components except for the cylinder 133, such as vane slots 1342*a*, 1342*b*, and 1342*c* of the roller 134, and vanes 1351, 1352, and 1353 are the same as those of the previous embodiment. Therefore, repetitive description thereof has been omitted.

Unequally spaced vane slots according to this embodiment may also be applied to a case in which the inner circumferential surface of the cylinder is formed in a circular shape having a constant curvature.

Figure 12:
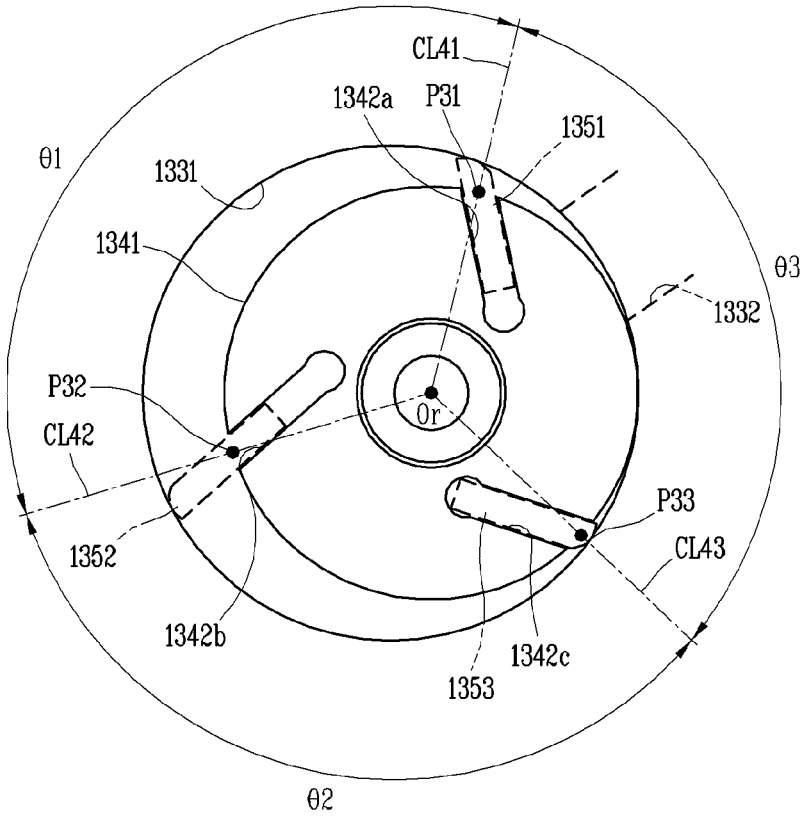
FIG. 12 is a planar view illustrating an example in which unequally spaced vane slots are employed in a cylinder having a circular shape according to an embodiment.

FIG. 12 is a planar view illustrating an example in which unequally spaced vane slots are employed in a cylinder having a circular shape according to an embodiment. Referring to FIG. 12, cylinder 133 according to this embodiment may have inner circumferential surface 1331 with a circular shape. For example, the inner circumferential surface 1331 of the cylinder 133 may have a constant (or same) curvature in the circumferential direction.

Even in this case, configurations and effects of components except for the cylinder 133, such as vane slots 1342*a*,

1342*b*, and 1342*c* of roller 134 and vanes 1351, 1352, and 1353 are similar to those of the previous embodiments. Therefore, repetitive description has been omitted.

When the inner circumferential surface 1331 of the cylinder 133 is formed in the circular shape as in this embodiment, an inflection point is not formed on the inner circumneutral surface 1331 of the cylinder 133. However, even in this case, the vanes 1351, 1352, and 1353 are in close contact with the inner circumferential surface 1331 of the cylinder 133 by being pressed by oil (or refrigerant) accommodated in back pressure chambers 1343*a*, 1343*b*, and 1343*c*, and pressures of the back pressure chambers 1343*a*, 1343*b*, and 1343*c* that press the vanes 1351, 1352, and 1353 toward the inner circumferential surface 1331 of the cylinder 133 are not uniform. As a result, the vanes 1351, 1352, and 1353 may generate noise while slightly trembling with respect to the cylinder 133. This phenomenon may regularly occur at a specific crank angle, causing periodicity of noise.

However, as the vane slots 1342*a*, 1342*b*, and 1342*c* according to this embodiment are formed at unequal intervals, the periodicity of noise between the cylinder 133 and the vanes 1351, 1352, and 1353 slidably inserted into the respective vane slots 1342*a*, 1342*b*, and 1342 may be reduced. Accordingly, the overall noise may be reduced and the effect of noise reduction in a specific band may be improved.

Hereinafter, a roller according to another embodiment will be described. That is, in the examples described above, the vane slots defined in the roller are formed in the inclined manner. However, in some cases, a plurality of vane slots may be formed in the radial direction. Even in this case, intervals between the vane slots, namely, intervals between the vanes may be unequal.

Figure 13:
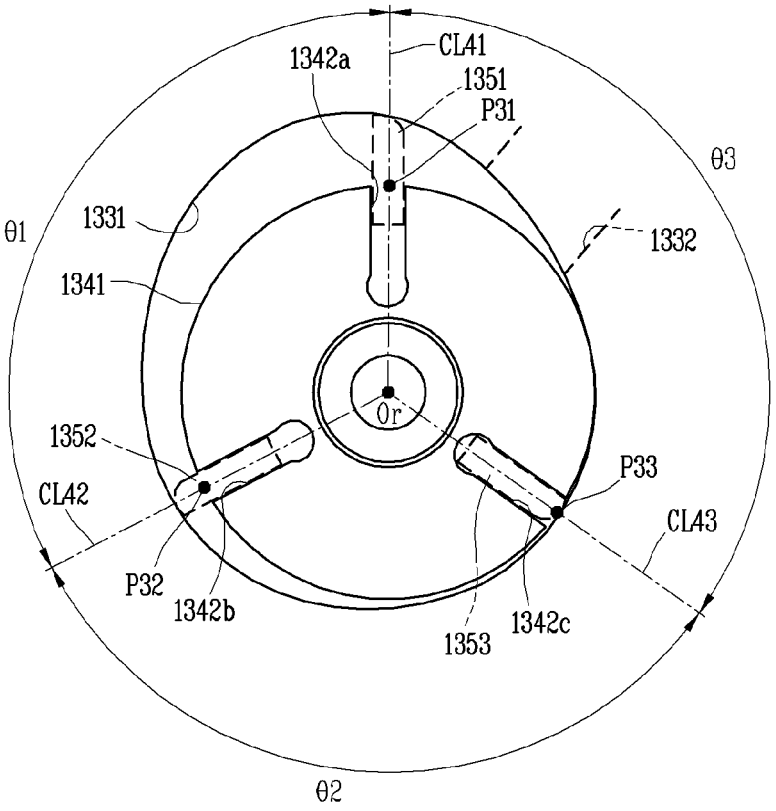
FIG. 13 is a planer view of a roller in which examples of vane slots are employed according to an embodiment.

FIG. 13 is a planer view of a roller in which vane slots according to an embodiment are employed. Referring to FIG. 13, roller 134 according to this embodiment may have a circular shape to be coupled to rotational shaft 123 or integrally formed with the rotational shaft 123. The roller 134 may be provided with a plurality of vane slots 1342*a*, 1342*b*, and 1342*c* formed along the circumferential direction.

Vanes 1351, 1352, and 1353 are slidably inserted the vane slots 1342*a*, 1342*b*, and 1342*c*, respectively. The vanes 1351, 1352, and 1353 may be drawn out of the respective vane slots 1342*a*, 1342*b*, and 1342*c* to be brought into close contact with inner circumferential surface 1331 of cylinder 133. The basic structure and operating effects of the vane rotary compressor including the roller 134 and the vanes 1351, 1352, and 1353 are substantially the same as those of the previous embodiments, and thus, repetitive description thereof has been omitted.

However, in this embodiment, the plurality of vane slots 1342*a*, 1342*b*, and 1342*c* may be formed in the radial direction based on rotational center Or of the roller 134. That is, in the previous embodiments, the plurality of vane slots 1342*a*, 1342*b*, and 1342*c* are inclined with respect to the radial direction. In this embodiment, however, the plurality of vane slots 1342*a*, 1342*b* and 1342*c* may be disposed in the radial direction with respect to the rotational center Or of the roller 134.

The plurality of vane slots 1342*a*, 1342*b*, and 1342*c* may be disposed at predetermined intervals in the circumferential direction, and the intervals between the vane slots 1342*a*, 1342*b*, and 1342*c*, namely, the intervals between the vanes 1351, 1352, and 1353 may be unequal as in the embodiments described above. The intervals between the vane slots 1342*a*, 1342*b*, and 1342*c* or the vanes 1351, 1352, and 1353 may be determined according to [Equation 1] described above. Accordingly, the periodicity of noise may be reduced to thereby lower the overall noise. Further, the effect of noise reduction in a specific band may be improved.

Although not illustrated in the drawings, the cylinder 133 may be a symmetrical ellipse or a true circle having an inner circumferential surface with a constant curvature in addition to the asymmetrical ellipse.

Embodiments disclosed herein provide a rotary compressor that can reduce noise of the compressor. Embodiments disclosed herein also provide a rotary compressor that can reduce noise of the compressor by reducing periodicity of the noise.

Embodiments disclosed herein further provide a rotary compressor that can reduce periodicity of noise by allowing vanes to pass through a specific crank angle at irregular (or different) time intervals. Embodiments disclosed herein furthermore provide a rotary compressor that can reduce shaking or trembling noise of a vane slidably inserted into a vane slot of a roller.

Embodiments disclosed herein provide a rotary compressor that can disperse pressure directed toward a cylinder so as to allow a vane to be in close contact with a side surface of a vane slot. Embodiments disclosed herein also provide a rotary compressor that can increase the compression efficiency and the effect of noise reduction by adjusting force that causes a vane to come in close contact with a side surface of a vane slot according to the condition of a compressor.

Embodiments disclosed herein provide a rotary compressor that may include a plurality of vane slots formed along an outer circumferential surface of a roller, and a plurality of vanes slidably inserted into the plurality of vane slots, respectively. Embodiments disclosed herein may include one or more of the following. For example, the plurality of vanes may be formed such that intervals between each of two adjacent vanes are different from each other. Accordingly, compressor noise may be reduced to thereby reduce periodicity of the noise.

Embodiments disclosed herein provide a rotary compressor that may include a vane slot formed along an outer circumferential surface of a roller, and a vane slidably inserted into the vane slot. Embodiments disclosed herein may include one or more of the following. For example, a chamfer portion may be formed at one edge of the vane to be inclined or stepped with respect to a lengthwise direction of the vane. With this configuration, a force that causes the vane to come in contact with a side surface of the vane slot may be generated to thereby reduce shaking of the vane. As a result, noise of the compressor may be reduced.

A cylinder may have an inner circumferential surface with an annular shape to form a compression space. A roller may be rotatably inserted into the compression space of the cylinder, and a plurality of vane slots may be disposed at predetermined intervals along an outer circumferential surface of the roller. A plurality of vanes may be slidably inserted into the plurality of vane slots, respectively, and the plurality of vanes may divide the compression space into a plurality of compression chambers while rotating together with the roller. At least one of the plurality of vane slots may be unequally spaced in a circumferential direction. Accordingly, periodicity of the vanes passing through a specific crank angle becomes non-uniform, thereby reducing periodicity of noise. As a result, a sharp pure tone at a specific frequency may be alleviated to thereby reduce noise of the compressor.

The outer circumferential surface of the roller may have a circular shape with a constant diameter in the circumferential direction, and the plurality of vane slots may be formed such that at least one of angles between two adjacent virtual lines, of virtual lines respectively connecting an entry point thereof in contact with the outer circumferential surface of the roller and a rotational center of the roller, is different. Accordingly, the plurality of vane slots may be disposed at unequal intervals along the circumferential direction.

The plurality of vane slots may be formed such that longitudinal center lines thereof intersect the virtual lines, respectively, at a predetermined inclination angle. Thus, periodicity of noise may be reduced even when the plurality of vane slots are inclined with respect to a radial direction.

The plurality of vane slots may have a same inclination angle. Accordingly, the vane slots may be disposed at equal intervals while being inclined with respect to the radial direction, allowing an eccentric load of the roller including the vanes to be suppressed.

At least one of the plurality of vane slots may have a different inclination angle. Accordingly, the vane slots may be disposed at unequal intervals while being inclined with respect to the radial direction.

The plurality of vane slots may be formed such that longitudinal center lines thereof are formed in a radial direction with respect to a rotational center of the roller. Accordingly, the vane slots may be formed in the radial direction and disposed at unequal intervals.

The outer circumferential surface of the roller may have a circular shape with a constant diameter in the circumferential direction, and angles between virtual lines respectively passing through entry points of the plurality of vane slots in contact with the outer circumferential surface of the roller and a rotational center of the roller may satisfy the following formula: $\theta i' = \theta i + \Delta\theta \times \mathrm{Sin}\,(m \times \theta i)$, where $\theta i$ denotes an equal interval angle, $\theta i'$ denotes a rearrangement angle of the vane slots, $\Delta\theta$ denotes a maximum variable angle, and m denotes the order of the vanes. Thus, the plurality of vane slots may be disposed at unequal intervals, and the intervals may be optimized.

The maximum variable angle $\Delta\theta$ in the formula may be 2 to 10°. Accordingly, the plurality of vane slots may be disposed at unequal intervals to thereby reduce compressor noise while maintaining compression efficiency.

Each of the plurality of vanes may include a vane front end portion in contact with the inner circumferential surface of the cylinder, and a vane rear end portion disposed at an end surface opposite to the vane front end portion to receive pressure, and a chamfer portion may be formed at the vane rear end portion. This allows the vanes to be brought into close contact with side surfaces of the vane slots to thereby reduce shaking of the vanes. As a result, noise of the compressor may be reduced.

The chamfer portion may be formed at an edge disposed in a rotational direction of the roller in an inclined or stepped manner. By using pressure generated at rear sides of the vanes, the vanes may be brought into contact with side surfaces of the vane slots in an easier manner.

A cross-sectional area of the chamfer portion in a widthwise direction may be less than or equal to a cross-sectional area of the vane rear end portion in the widthwise direction. Accordingly, shaking of the vanes during low-speed operation or when using high-pressure refrigerant may be reduced. As a result, noise of the compressor may be reduced. In addition, adhesion to the cylinder may be increased to thereby reduce compression loss.

A cross-sectional area of the chamfer portion in a widthwise direction may be greater than or equal to a cross-sectional area of the vane rear end portion in the widthwise direction. Accordingly, shaking of the vanes during high-speed operation or when using low-pressure refrigerant may be reduced. As a result, noise of the compressor noise may be reduced. In addition, adhesion to the cylinder may be reduced to thereby reduce friction loss.

The inner circumferential surface of the cylinder may have an asymmetric elliptical shape. With this configuration, even when the inner circumferential surface of the cylinder is asymmetric, periodicity of noise may be reduced to thereby lower noise of the compressor.

The inner circumferential surface of the cylinder may have a symmetric elliptical shape. With this configuration, even when the inner circumferential surface of the cylinder is symmetric, periodicity of noise may be reduced to thereby lower noise of the compressor.

The inner circumferential surface of the cylinder may have a circular shape with a constant curvature. With this configuration, even when the inner circumferential surface of the cylinder has the circular shape, periodicity of noise may be reduced to thereby lower noise of the compressor.

Embodiments disclosed herein provide a rotary compressor that may include a cylinder having an inner circumferential surface with an annular shape to form a compression space, a roller rotatably inserted into the compression space of the cylinder and provided with one or more vane slots disposed at a predetermined interval along a circumferential surface thereof, and a vane slidably inserted into the vane slot and drawn out from the vane slot to divide the compression space into a plurality of compression chambers while rotating together with the roller. The vane may include a vane front end portion in contact with the inner circumferential surface of the cylinder, and a vane rear end portion disposed at an end surface opposite to the vane front end portion to receive pressure. A chamfer portion for pressing the vane toward an inner surface of the vane slot may be formed on an edge, of edges of the vane rear end portion in a circumferential direction, disposed in a rotational direction of the roller. This may allow the vane to be in close contact with a side surface of the vane slot. As a result, shaking of the vane may be reduced to thereby reduce noise of the compressor.

Although not illustrated in the drawings, embodiments disclosed herein are not necessarily limited to three vane slots.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a cylinder having an inner circumferential surface with an annular shape to form a compression space;

a roller rotatably provided in the compression space of the cylinder and having a plurality of vane slots disposed at predetermined intervals along an outer circumferential surface thereof; and a plurality of vanes slidably inserted into the respective vane slots to rotate with the roller and by which the compression space is divided into a plurality of compression chambers, wherein at least one of the plurality of vane slots is unequally spaced in a circumferential direction, wherein the outer circumferential surface of the roller has a circular shape with a constant diameter in the circumferential direction, and wherein angles between virtual lines respectively passing through entry points of the plurality of vane slots in contact with the outer circumferential surface of the roller and a rotational center of the roller satisfy the following formula:

$\theta i=\theta i+\Delta\theta\times\mathrm{Sin}(m\times\theta i)$, where $\theta i$ denotes an equal interval angle, $\theta i'$ denotes a rearrangement angle of the vane slots, $\Delta\theta$ denotes a maximum variable angle, and m denotes the order of the vanes.

2. The rotary compressor of claim 1, wherein the outer circumferential surface of the roller has a circular shape with a constant diameter in the circumferential direction, and wherein the plurality of vane slots is formed such that at least one of angles between two adjacent virtual lines, of virtual lines respectively connecting entry points thereof in contact with the outer circumferential surface of the roller and a rotational center of the roller, is different.

3. The rotary compressor of claim 2, wherein the plurality of vane slots is formed such that longitudinal center lines thereof intersect the virtual lines, respectively, at a predetermined inclination angle.

4. The rotary compressor of claim 3, wherein the plurality of vane slots has a same inclination angle.

5. The rotary compressor of claim 3, wherein at least one of the plurality of vane slots has a different inclination angle.

6. The rotary compressor of claim 2, wherein the plurality of vane slots is formed such that longitudinal center lines thereof are formed in a radial direction with respect to the rotational center of the roller.

7. The rotary compressor of claim 1, wherein the maximum variable angle $\Delta\theta$ is 2 to 10°.

8. The rotary compressor of claim 1, wherein each of the plurality of vanes includes a vane front end portion in contact with the inner circumferential surface of the cylinder, and a vane rear end portion disposed at an end surface opposite to the vane front end portion to receive pressure, and wherein a chamfer portion is formed at the vane rear end portion.

9. The rotary compressor of claim 8, wherein the chamfer portion is formed at an edge disposed in a rotational direction of the roller in an inclined or stepped manner.

10. The rotary compressor of claim 8, wherein a cross-sectional area of the chamfer portion in a widthwise direction is less than or equal to a cross-sectional area of the vane rear end portion in the widthwise direction.

11. The rotary compressor of claim 8, wherein a cross-sectional area of the chamfer portion in a widthwise direction is greater than or equal to a cross-sectional area of the vane rear end portion in the widthwise direction.

12. The rotary compressor of claim 1, wherein the inner circumferential surface of the cylinder has an asymmetric elliptical shape.

13. The rotary compressor of claim 1, wherein the inner circumferential surface of the cylinder has a symmetric elliptical shape.

14. The rotary compressor of claim 1, wherein the inner circumferential surface of the cylinder has a circular shape with a constant curvature.

15. A rotary compressor, comprising:

a cylinder having an inner circumferential surface with an annular shape to form a compression space;

a roller rotatably provided in the compression space of the cylinder and having a plurality of vane slots disposed at predetermined intervals along an outer circumferential surface thereof; and a plurality of vanes slidably inserted into the respective vane slots to rotate with the roller and by which the compression space is divided into a plurality of compression chambers, wherein the plurality of vanes pass through a specific crank angle at irregular time intervals, wherein the outer circumferential surface of the roller has a circular shape with a constant diameter in the circumferential direction, and wherein angles between virtual lines respectively passing through entry points of the plurality of vane slots in contact with the outer circumferential surface of the roller and a rotational center of the roller satisfy the following formula:

$\theta i = \theta i + \Delta\theta \times \mathrm{Sin}(m \times \theta i)$, where $\theta i$ denotes an equal interval angle, $\theta i'$ denotes a rearrangement angle of the vane slots, $\Delta\theta$ denotes a maximum variable angle, and m denotes the order of the vanes.

16. The rotary compressor of claim 15, wherein intervals between each of two adjacent vanes of the plurality of vanes are different.

17. The rotary compressor of claim 15, wherein at least one of the plurality of vane slots has a different inclination angle with respect to a virtual line that passes from a center of the roller to an outer circumferential surface of the roller.

18. The rotary compressor of claim 15, wherein each of the plurality of vane slots has a same inclination angle with respect to a virtual line that passes from a center of the roller to an outer circumferential surface of the roller.

* * * * *